US007508917B2

(12) United States Patent
Dittrich et al.

(10) Patent No.: US 7,508,917 B2
(45) Date of Patent: Mar. 24, 2009

(54) X-RAY RADIATOR WITH A PHOTOCATHODE IRRADIATED WITH A DEFLECTED LASER BEAM

(75) Inventors: Ronald Dittrich, Forchheim (DE); Joerg Freudenberger, Eckental (DE); Sven Fritzler, Erlangen (DE); Manfred Fuchs, Nürnberg (DE); Detlef Mattern, Erlangen (DE); Peter Roehrer, Uttenreuth (DE); Peter Schardt, Höchstadt A.D. Aisch (DE)

(73) Assignee: Siemens Aktiengesellscahft, Munich (DE)

( * ) Notice: Subject to any disclaimer, the term of this patent is extended or adjusted under 35 U.S.C. 154(b) by 0 days.

(21) Appl. No.: 11/752,548

(22) Filed: May 23, 2007

(65) Prior Publication Data

US 2007/0274453 A1 Nov. 29, 2007

(30) Foreign Application Priority Data

May 24, 2006 (DE) ..... 10 2006 024 435

(51) Int. Cl.
*H01J 35/06* (2006.01)
*H01J 35/10* (2006.01)

(52) U.S. Cl. ..... 378/136; 378/141; 378/199

(58) Field of Classification Search ..... 378/119, 378/136, 141, 144, 199, 200, 121
See application file for complete search history.

(56) References Cited

U.S. PATENT DOCUMENTS

| | | | | |
|---|---|---|---|---|
| 4,414,681 | A | 11/1983 | Seifert | |
| 4,821,305 | A | 4/1989 | Anderson | |
| 5,768,337 | A | 6/1998 | Anderson | |
| 6,463,124 | B1 | 10/2002 | Weisman et al. | |
| 6,556,651 | B1 | 4/2003 | Thomson et al. | |
| 7,062,017 | B1 * | 6/2006 | Runnoe | 378/136 |
| 2006/0233307 | A1 * | 10/2006 | Dinsmore | 378/136 |

FOREIGN PATENT DOCUMENTS

| | | |
|---|---|---|
| DE | G 87 13 042.4 | 3/1989 |
| EP | 0 147 009 | 9/1984 |
| JP | 3-285329 | 12/1991 |
| WO | WO 2005/112070 | 11/2005 |

* cited by examiner

*Primary Examiner*—Irakli Kiknadze
(74) *Attorney, Agent, or Firm*—Schiff Hardin LLP

(57) ABSTRACT

An x-ray radiator has an anode that emits x-rays, a cathode that thermionically emits electrons upon irradiation thereof by a laser beam, a voltage source for application of a high voltage between the anode and the cathode for acceleration of the emitted electrons toward the anode to form an electron beam, a vacuum housing, an insulator that is part of the vacuum housing and that separates the cathode from the anode, an arrangement for cooling components of the x-ray radiator, a deflection and arrangement that deflects the laser beam from a stationary source, that is arranged outside of the vacuum housing, to a spatially stationary laser focal spot on the cathode.

20 Claims, 6 Drawing Sheets

X-RAY RADIATOR WITH A PHOTOCATHODE IRRADIATED WITH A DEFLECTED LASER BEAM

BACKGROUND OF THE INVENTION

1. Field of the Invention

The present invention concerns an x-ray radiator with a cathode and an anode, of the type wherein the cathode has a surface that emits electrons upon laser irradiation of the surface.

2. Description of the Prior Art

High-capacity x-ray radiators typically have an anode that is mounted to rotate in order to ensure a high thermal loading capability of the anode during generation of x-rays with high radiation power.

DE 87 13 042 U1 describes an x-ray tube with an evacuated housing (the housing is evacuated in order to be mounted such that it can be rotated around a rotation axis) in which a cathode and an anode are arranged. The cathode and the anode are connected in a fixed manner with the housing. The x-ray tube has drive means for rotation of the housing around the rotation axis. A deflection system that is stationary relative to the housing deflects an electron beam proceeding from the cathode to the anode such that it strikes the anode on an annular impact surface, the axis of this annular impact surface corresponding to the rotation axis that runs through the cathode. Since the anode is connected in a heat-conductive manner with the wall of the housing, heat dissipation from the anode to the outer surface of the housing is ensured. An effective cooling is possible via a coolant that is admitted to the housing.

In this arrangement a relatively long electron flight path is present due to the axis-proximal position of the cathode and the axis-remote position of the impact surface of the anode. This creates problems in the focusing of the electron beam. Among other things, a problem occurs in the generation of soft x-ray radiation given which a comparably low voltage is applied between cathode and anode. Due to the lower kinetic energy of the electrons, a higher defocusing of the electron beam occurs, dependent on the space charge limitation. The use of such an x-ray tube is possible only in a limited manner for specific applications (such as, for example, mammography).

U.S. Pat. No. 4,821,305 discloses an x-ray tube is described in which both the anode and the cathode are arranged axially symmetrically in a vacuum housing that can be rotated as a whole around an axis. The cathode is thus mounted so it can rotate and has an axially symmetrical surface made of a material that photoelectrically emits electrons upon exposure to light of appropriate power (photoelectrons). The electron emission is triggered by a spatially stationary light beam that is focused from the outside of the vacuum housing through a transparent window onto the cathode.

The practical feasibility of this concept, however, appears to be questionable due to the quantum efficiency of available photo-cathodes and the light power that is required. Given use of high light power, the cooling of the photo-cathode requires a considerable expenditure due to its rather low heat resistance. In view of the vacuum conditions that exist in x-ray tubes, the surface of the photo-cathode is additionally subjected to oxidation processes, which limits the durability of such an x-ray tube.

In U.S. Pat. No. 5,768,337, a photomultiplier is interposed between a photo-cathode and the anode in a vacuum housing in which the photo-cathode and the anode are arranged. Thus, a lower optical power is necessary for generation of x-ray radiation. The longer electron flight path with repeated deflection of the electron beam between the dynodes, however, requires a high expenditure for focusing the beam.

An x-ray scanner (in particular a computed tomography scanner) is known from EP 0 147 009 B1. X-rays are thereby generated by an electron beam striking an anode. Among other things, the possibility is mentioned to generate the electron beam by thermionically-emitted electrons by heating the cathode surface with a light beam. The surface of the cathode should be capable of being heated and cooled quickly in the disclosed embodiment of the cathode with a substrate layer made of a material with high heat conductivity, but this appears to be problematic with regard to the light power that is required.

U.S. Pat. No. 6,556,651 describes a system for generation of therapeutic x-rays. Among other things, the possibility is generally mentioned that the electron beam required for the generation of x-ray radiation is emitted by a thermionic cathode heated by a laser.

It is described that the injection (launching) of a laser beam onto a cathode in a sealed x-ray tube should generally be as flexible as possible in order, for example, to enable a fast change of the focal spot size that is determined by the size the of the laser beam. This injection must also be suitable for industrial uses, meaning that the optics must be protected to the greatest extent possible from contamination.

SUMMARY OF THE INVENTION

An object of the present invention is to provide injection of a laser beam onto a cathode in a sealed x-ray tube in a manner that is particularly flexible and suitable for industry.

This object is achieved in accordance with the invention by an x-ray radiator having an anode that emits x-rays when struck by electrons, a cathode that thermionically emits electrons upon irradiation thereof by a laser beam a voltage source that applies a voltage between the anode and the cathode for acceleration of the emitted electrons toward the anode to form an electron beam, a vacuum housing, an arrangement for cooling of components of the x-ray radiator, and a deflection arrangement that deflects the laser beam in its path from a stationary source, that is arranged outside of the vacuum housing, to a spatially stationary laser focal spot on the cathode. The laser beam is thus not simply directed completely linearly from outside onto the cathode, but rather is deflected onto the cathode from the initial beam path that it assumes upon exiting the laser source.

This x-ray radiator allows a beam direction to be set particularly simply and flexibly. A greater distance between the site of the injection and the site of the generation of the electrons additionally can be produced, which can significantly reduce contamination of windows through which the beam must pass. Moreover, the manner of the injection is also suitable for realization in "non-mechanical CT" and can be realized with a high degree of effectiveness. Particularly compact designs are also possible.

The laser beam defection arrangement can include a reflection element (for example a mirror, a totally reflecting surface, etc.) and/or at least one optical conductor.

The above x-ray radiator is not limited in type and, as noted above, be used in CT systems of the type known as "non-mechanical CTs". However, it is advantageous when the vacuum housing can be rotated on an axis and the x-ray radiator has a drive for rotation of the vacuum housing around its axis. For a compact design and a reliable operation, it is then advantageous for the laser beam to be deflected off the rotation axis by the deflection arrangement from a beam direction that is essentially parallel to the rotation axis (in particular on the rotation axis) toward the cathode.

For a compact design it is particularly advantageous to provide an optically transparent window for passage of the laser beam into the vacuum housing, at the vacuum housing in the region of the rotation axis of the vacuum housing or on the anode side outside of the periphery of the anode. It can be advantageous for the laser beam to be injected into the vacuum housing on the anode side in the region of the rotation axis (thus generally proceeding through the anode). The deflection arrangement can the be provided in the vacuum region, or can already deflect the beam in the region of the anode before the vacuum.

Alternatively, the laser beam can be injected into the vacuum housing on the cathode side in the region of the rotation axis.

The laser beam can also be directed between anode and cathode and be injected from at that location into the vacuum housing.

For a simple beam direction and production it is advantageous for the deflection arrangement to be a reflection element that is arranged on the electrode situated opposite an optically transparent window, thus (for example) on the anode when the laser beam is injected on the cathode side, and vice versa.

It is advantageous for the x-ray radiator to have a focusing optics for focusing the laser beam onto the cathode. This can be integrated into the arrangement for deflection of the laser beam.

It is also possible to mount the surface of the cathode on a support layer (substrate), so the laser beam is directed through the support layer of the cathode onto the surface of the cathode, for example without having to enter into the vacuum housing. For increased injection efficiency and to protect against clouding of the window, it is advantageous to form the cathode as a circular ring, in particular with large diameter.

The use of an IR laser is advantageous.

DESCRIPTION OF THE PREFERRED EMBODIMENTS

Figure 1:
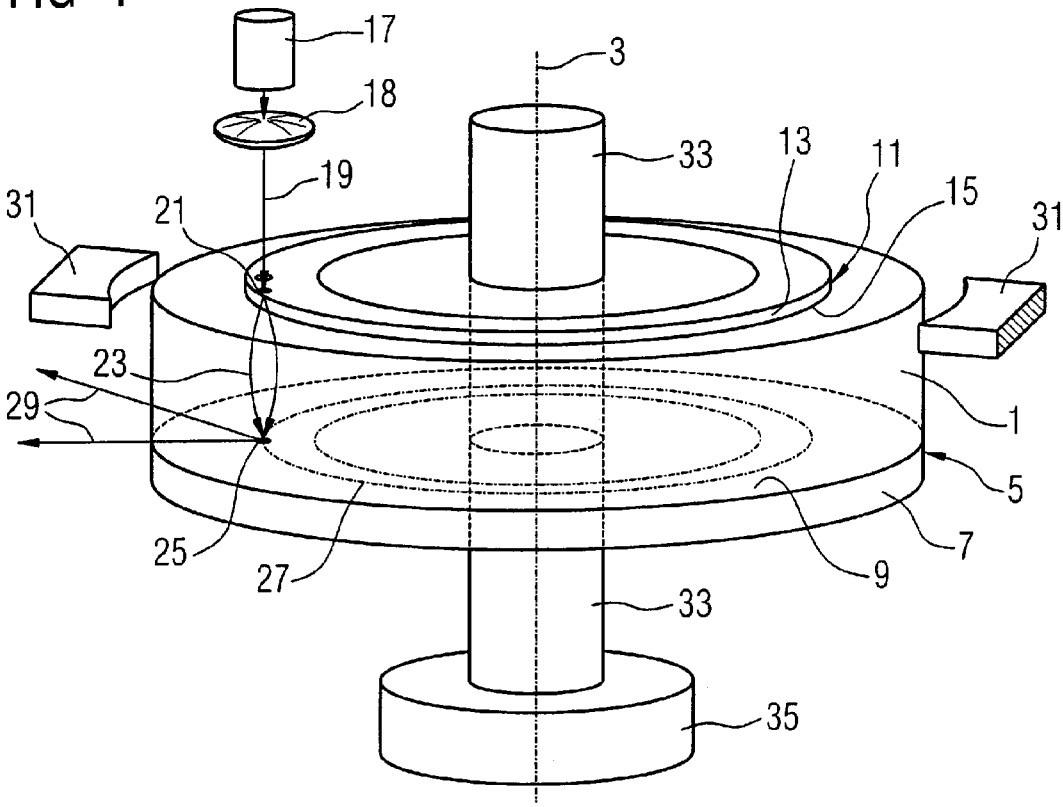
FIG. 1 schematically illustrates a vacuum housing of an x-ray radiator according to the invention.

A three-dimensional representation of a vacuum housing 1 is shown in FIG. 1. The vacuum housing 1 is fashioned as a cylinder (having a cylinder jacket formed of an insulating material) and the cylinder is mounted in a rotationally symmetrical manner on an axis 3. An anode 5 forms a base of the cylinder. The anode 5 has a support layer 7 and an annularly-fashioned surface 9 from which x-rays 29 are emitted. An annularly-fashioned cathode 11 is located in the opposite base of the vacuum housing 1 (cylinder). The cathode 11 has a support layer 13 that is part of the exterior of the vacuum housing 1 and a surface 15 that facing the interior of the vacuum housing 1.

The anode 5 and cathode 11 shown in FIG. 1 are fashioned axially symmetrically, such that the electron beam or the laser beam always strikes the surface of the anode 5, or the cathode 11 during the rotation. However, it can also be advantageous to fashion the anode 5 and the cathode 11 (in particular their support layers 7, 13) such that they exhibit only one axis of symmetry. This means a segmented design of the cathode 11 or the anode 5, such that a rotation of the cathode 11 or of the anode 5 by a whole-number divisor of 360° leads to an identical image of the cathode 11 or of the anode 5; materials of higher mechanical stability that are arranged as spokes in the cathode 11 or in the anode 5 can support segments of materials with high emission efficiency.

The surface 15 of the cathode 11 is formed of a material having a low vapor pressure and a high melting point (such as, for example, tungsten, which is typically used in x-ray cathodes). The carrier layer 13 is optimized with regard to its heat capacity, its heat conductivity and its density such that the temperature of the surface 15 is kept near the temperature required for the thermionic emission of electrons. A lower power of the laser beam 19 is thereby required. In one possible embodiment the support layer 13 is made of the same material as the surface 15, but the material in the support layer 13 is not in a solid, uniform form but rather in a sintered or porous structure. The density, the heat capacitor and/or the heat conductivity of the support layer 13 are thereby reduced in comparison to the surface 15. The temperature of the surface 15 can thereby be kept near to the emission temperature for electrons.

The laser beam is asymmetrically shaped (not shown), so an asymmetrical laser focal spot with different laser power can be generated within the laser focal spot. Laser power can thereby be saved; while approximately equally steeply rising and falling temperature gradients at the edges can be generated at the laser focal spot at the entrance and exit points of the cathode, which leads to an efficient electron emission at a constant level over the laser focal spot.

A laser beam 19 is directed from a spatially stationary light source 17 onto the cathode 11. The light source 17 is typically designed as a diode laser or as a solid-state laser. The laser beam 19 passes through the support layer 13 to strike the surface 15 of the cathode 11 at a laser focal spot 21. The laser beam 19 is varied in terms of its shape, intensity and/or time structure by optics 18, so the electron current strength can be correspondingly varied through the injected laser power. The laser beam thereby can also be split into partial laser beams. In this case each of the partial laser beams generates a partial laser focal spot of which the laser focal spot 21 is composed, thus an asymmetrical laser focal spot can be realized in a simple manner and a heating and cooling can be better controlled by this composite laser focal spot.

When (as in this case) the laser focal spot passes through the support layer 13 from outside of the vacuum housing 1 to strike the surface 15 of the cathode 11, the optics 18 that vary (adjust) the laser beam 19 in terms of its properties are arranged outside of the vacuum housing 1. In the event that (as is shown in FIG. 2) the laser beam enters into the inside of the vacuum housing 1 via an optically transparent window 63, the optics 18 can also be located inside the vacuum housing 1.

Electrons arise from the laser focal spot 21 in the form of an electron cloud and are directed onto the anode in an electron beam 23 by the high voltage applied between the cathode 11 and the anode 5. The electron beam 23 strikes the surface 9 of the anode 5 in a spatially stationary focal spot 25. Due to the rotation of the vacuum housing 1, the arising heat is distributed along the focal ring 27 on the surface 9 of the anode 5. The arising heat is conducted to the outside of the vacuum housing 1 via the support layer 7 of the anode 5.

X-ray radiation 29 is emitted from the focal spot 25, the material being transparent for x-ray radiation 29 at the point of the vacuum housing 1 from which the x-ray radiation 29 exists. A magnet system 31 is located outside of the vacuum housing 1, such that the electron beam 23 can be shaped and directed. Alternatively, an electrostatic arrangement (for example capacitors) with which the electron beam can be shaped and directed can be mounted instead of the magnet system 31. A motor 35 that is connected with the vacuum housing 1 via a drive shaft 33 rotates the vacuum housing 1 around its axis 3. The longitudinal axis of the drive shaft 33 coincides with the axis 3 of the vacuum housing 1. Connections to apply a high voltage between the anode 5 and the cathode 11 are located in the drive shaft 33.

Figure 2:
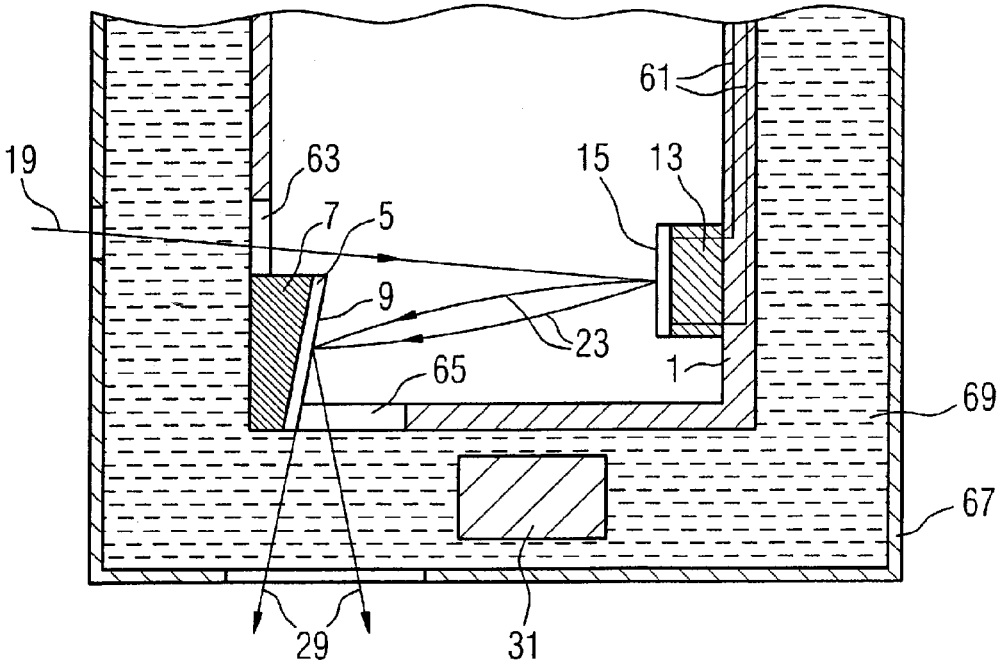
FIG. 2 schematically illustrates a longitudinal section through a portion of a further embodiment of the vacuum housing.

FIG. 2 shows a longitudinal section of a further cylindrical design of the vacuum housing 1. The cathode 11 has a surface 15 and a support layer 13 and is located entirely inside the vacuum housing 1. The laser beam 19 strikes the surface 15 of the cathode through an optically transparent window 63 that is located in the opposite base of the vacuum housing 1. So that the optical window does not lose transparency to any degree of severity in the course of the usage of the x-ray radiation, it can be protected by protective plates from clouding (fogging) with material that vaporizes during the operation of the x-ray radiator.

As in the embodiment shown in FIG. 1, the surface 15 of the cathode 11 can be heated by an electrical arrangement 61. The base temperature of the surface 15 of the cathode 11 thereby increases, such that less laser power is required in order to achieve the emission temperature. The surface 15 alternatively can be preheated optically (for example by a further laser beam) or inductively (by further magnetic fields) .

FIG. 2 shows a longitudinal section of a further cylindrical design of the vacuum housing 1. The cathode 11 has a surface 15 and a support layer 13 and is entirely located inside the vacuum housing 1. The laser beam 19 strikes the surface 15 of the cathode through an optically transparent window 63 that is located in the opposite base of the vacuum housing 1. Again, the optical window can be protected by protective plates from clouding (fogging) with material that vaporizes during the operation of the x-ray radiator.

Figure 3:
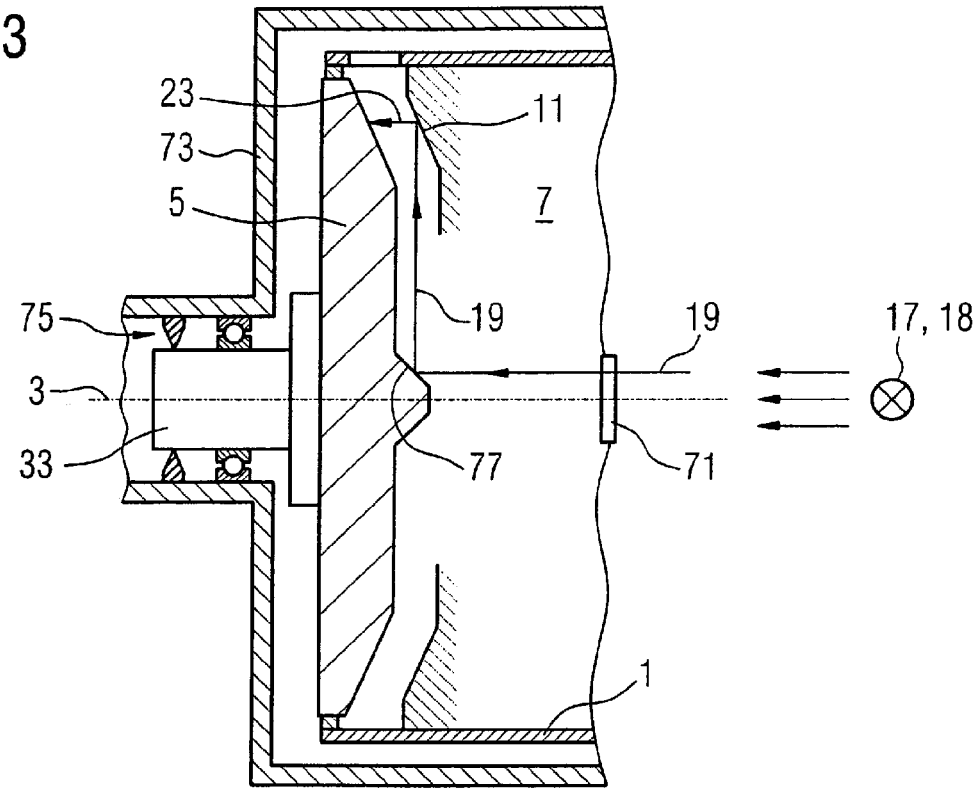
FIGS. 3 through 11 schematically illustrate longitudinal sections through a portion of respectively different embodiments of the x-ray radiator.

FIG. 3 shows a longitudinal section of a further embodiment of the x-ray radiator with a cathode-side central injection of the laser beam 19 into a vacuum housing 1. Here the vacuum housing 1 also accommodates the anode 5 and the cathode 11. The vacuum housing 1 is surrounded by a protective housing. Both housings 1, 73 can be mutually freely rotated via bearings 75. As in the above exemplary embodiments, the rotation of the vacuum housing 1 occurs via a drive shaft 33.

The laser beam 19 is initially generated by a laser 17 and radiated through focusing optics 18 (focusing optics 18 being located outside of the vacuum housing 1 and likewise is on the rotation axis 3) parallel to the rotation axis 3 and onto a window 71 arranged in the central region of the vacuum housing 1 on the rotation axis 3. The window 71 is, for example, similar in design to the window of FIG. 2. The diameter of the vacuum housing 1 around the rotation axis 3 is here approximately 115 cm and the diameter of the window 71 is 20-40 mm. As indicated by the group of arrows, the laser beam 19 can likewise exhibit a significant width, for example in the range of the window diameter (from 20-40 mm). However, the laser beam can also be fashioned more narrow, for example with half of the window diameter, in order to make asymmetrical radiation easier. In the extreme case the laser beam can be narrowly focused (for example with a diameter of 1 mm or even less). The laser is advantageously an infrared laser.

After passage though the window 71, the laser beam 19 strikes a mirror 77 that is arranged on the anode 5 and is aligned on the cathode. This mirror 77 has an angled surface that serves for essentially perpendicular deflection of the laser beam onto the annular cathode 11 that is held by a carrier 7. The laser beam 19 causes electrons to be emitted at the cathode 11, the electrons being accelerated toward the anode 5 due to the high voltage applied between cathode 11 and anode 5. The anode 5, the electrons generate x-ray radiation upon impact. The (rotating) cathode 11 exhibits a large diameter that protects the optically transparent window 71 from contamination/vaporization due to the large distance from the cathode 11. A further advantage is the shallow (and therefore effective) injection of the laser beam 19 into the material of the cathode 11.

Figure 4:
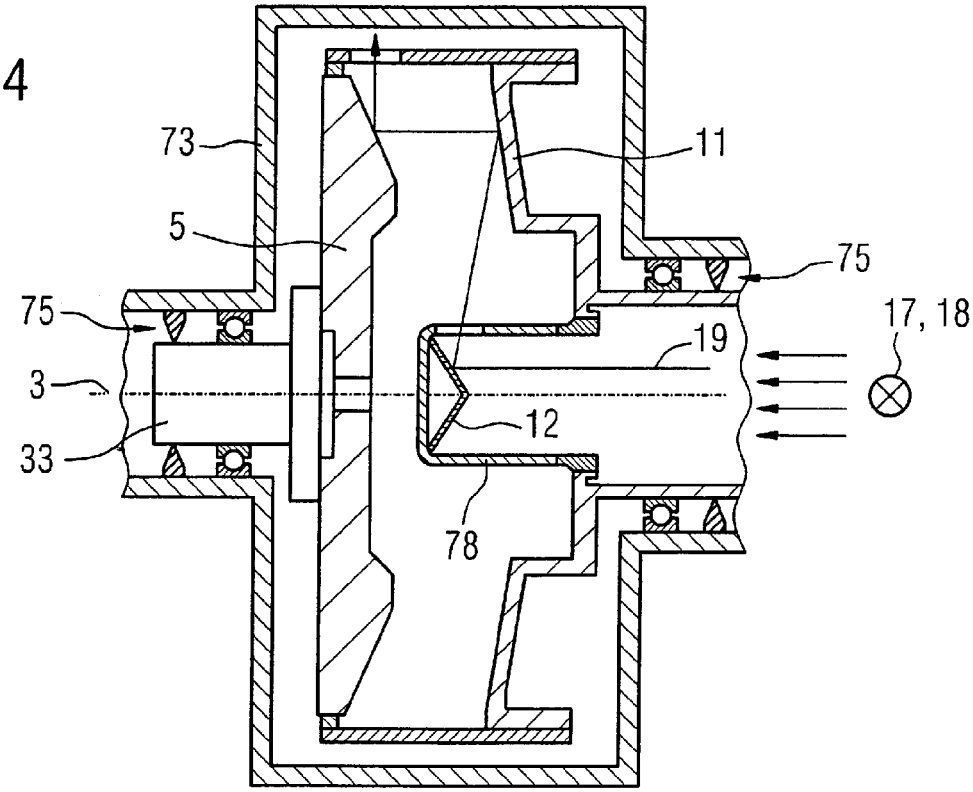

FIG. 4 shows a longitudinal section of a further embodiment of the x-ray radiator with a cathode-side, central injection of the laser beam 19. In contrast to the vacuum housing from FIG. 3, the central region at the cathode side is formed as a glass bulb or a rotating window 78 as a partition from the vacuum region. The last, conically curved mirror 12 is located within this glass bulb/rotating window. The cone shape of the mirror 12 has the effect that a wide laser beam 19 is also almost completely deflected on the cathode 11, and thus the effect is increased and a harmful back-scatter radiation is reduced. Displacement of this mirror 12 can avoid clouding on the glass one bulb 78 always at one location. It is advantageous that no optics are arranged in the vacuum region. A further advantage is the steep injection of the laser beam 19, which increases its injection efficiency in the cathode 11.

Figure 5:
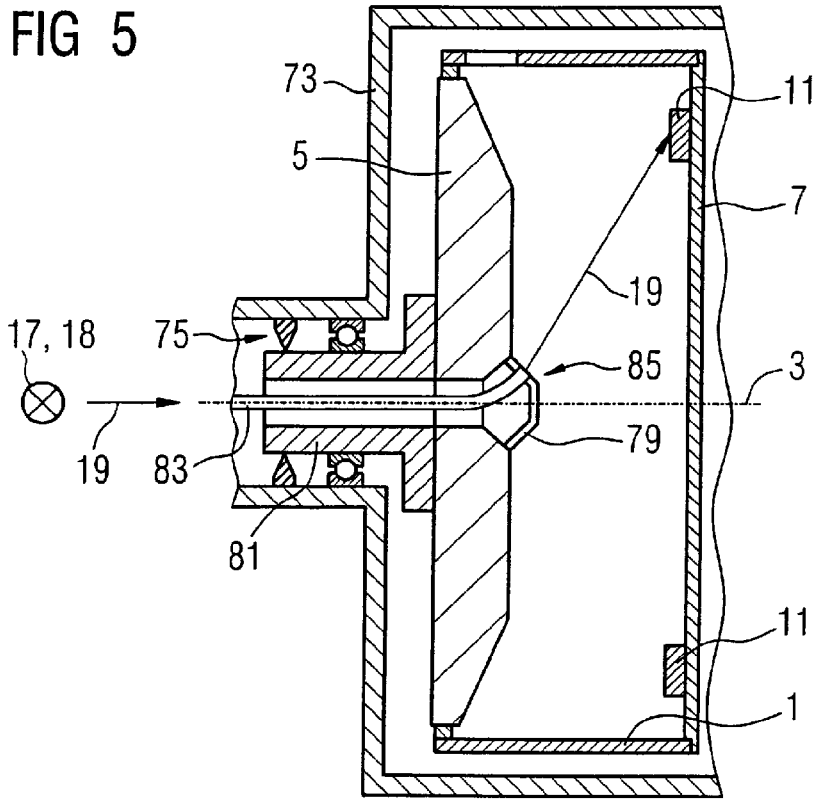

FIG. 5 shows a longitudinal section of a further embodiment of the x-ray radiator with a central injection (now on the anode side) of the laser beam 19 into the vacuum housing 1 by means of a mirror system (not shown) or a number of optical conductors 83. In this embodiment the x-ray tube is driven on the anode side by a hollow shaft 81 inside of which the laser beam 19 is directed. The vacuum-side end of the hollow shaft 81 is sealed (for example soldered by an optically transparent window 79. In both cases focusing optics 85 are required at the window 79 in order to focus the laser beam(s) 19 directly onto the cathode 11 without further mirrors in the vacuum region. When the high voltage generator and the drive (both not shown) are situated on the same side, the x-ray focal spot can lie close to the x-ray tube end.

Figure 6:
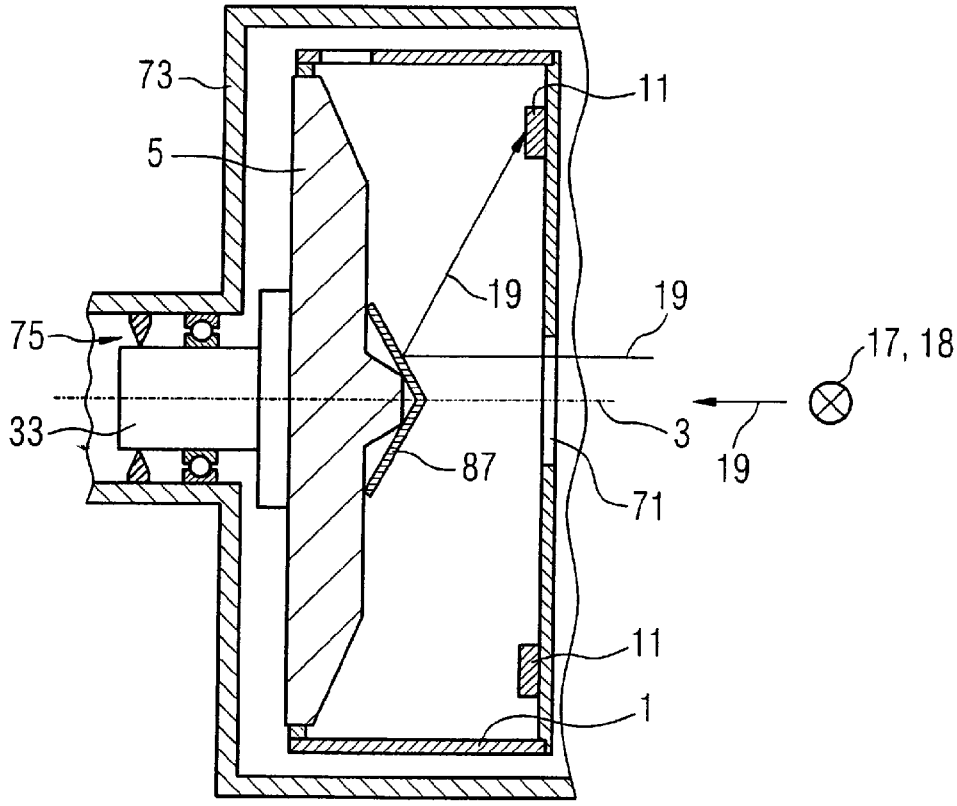

FIG. 6 shows as a longitudinal section a further embodiment of the x-ray radiator with a cathode-side central injection of the laser beam 19. In this embodiment the cathode 11 is thin, and the laser beam 19 is injected at a more shallow angle into the cathode such that a smaller focal spot can be achieved. A conically curved mirror 87 is mounted on the anode 5.

As in all other embodiments, an electrostatic blocking voltage for protection of the optics can also be applied in principle, the electrostatic blocking voltage preventing the window 71 from being attacked by particles vaporized from the cathode 11 and/or the anode 5.

Figure 7:
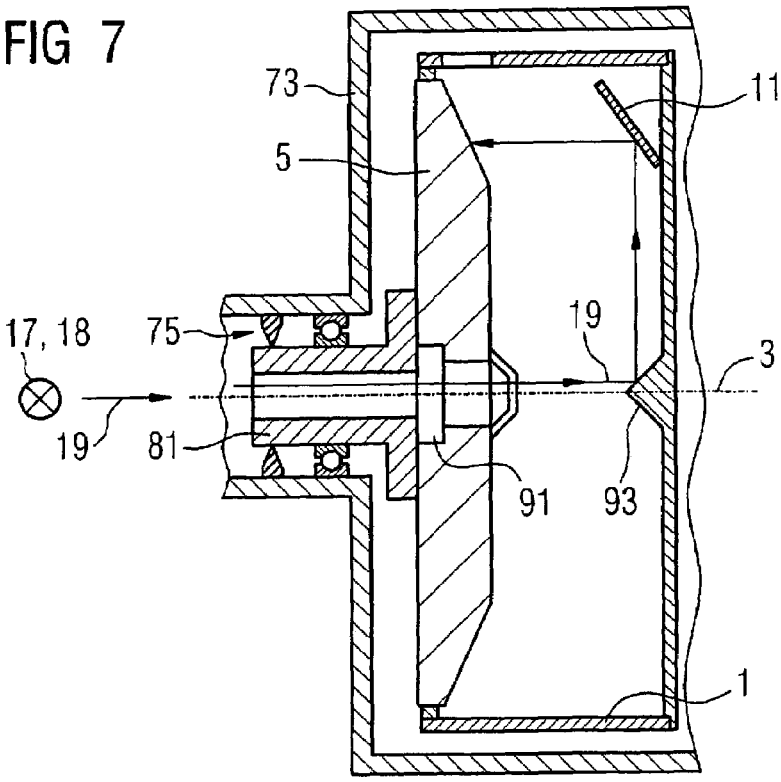

FIG. 7 shows a longitudinal section of a further embodiment of the x-ray radiator with an anode-side central injection of the laser. In this embodiment the laboratory 19 is again directed through a hollow shaft 81 (as a drive shaft) to an optically transparent window 91 that is countersunk into the anode 5 as a protection against fogging. In this embodiment the last mirror 93 (which is conical here) is located on the cathode 11 and directs the laser beam 19 essentially perpendicularly outwardly to the cathode 11.

Figure 8:
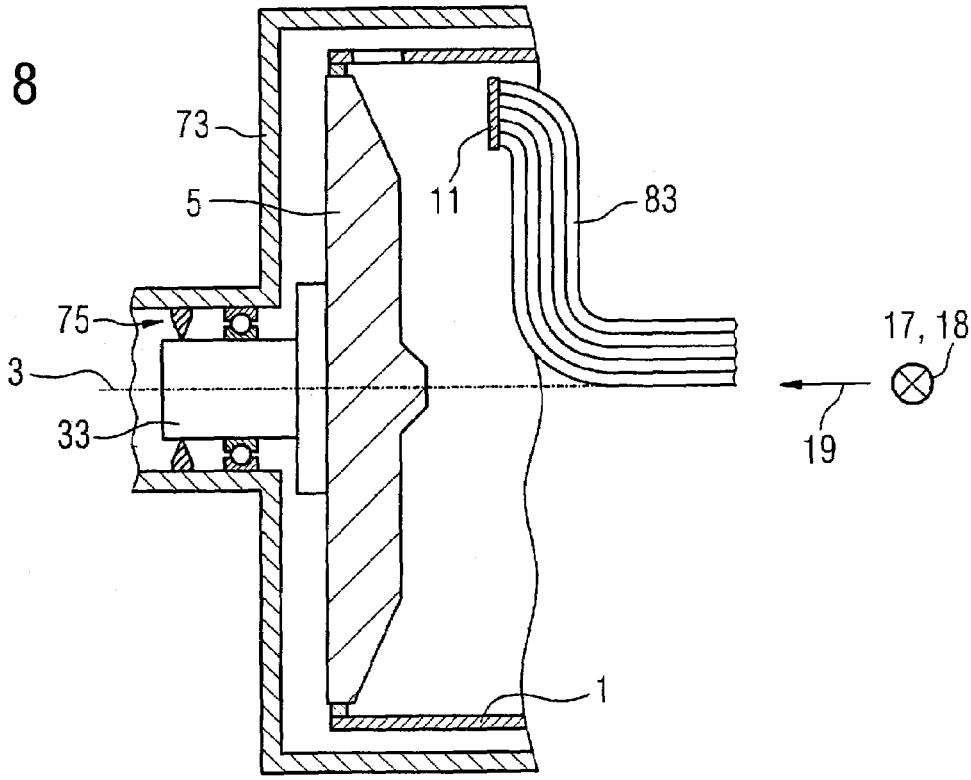

FIG. 8 shows a longitudinal section a further embodiment of the x-ray radiator with a central, cathode-side injection of the laser beam 19 by a number of curved optical conductors 83 which illuminate (irradiate) the (then sufficiently thin) cathode 11 on its back side. The deflection arrangement is thus the optical conductors 83. In this embodiment no optics are located in the vacuum region, such that an optimal protection for them exists since the emitter/the cathode 11 is heated from the sides facing away from the vacuum.

Figure 9:
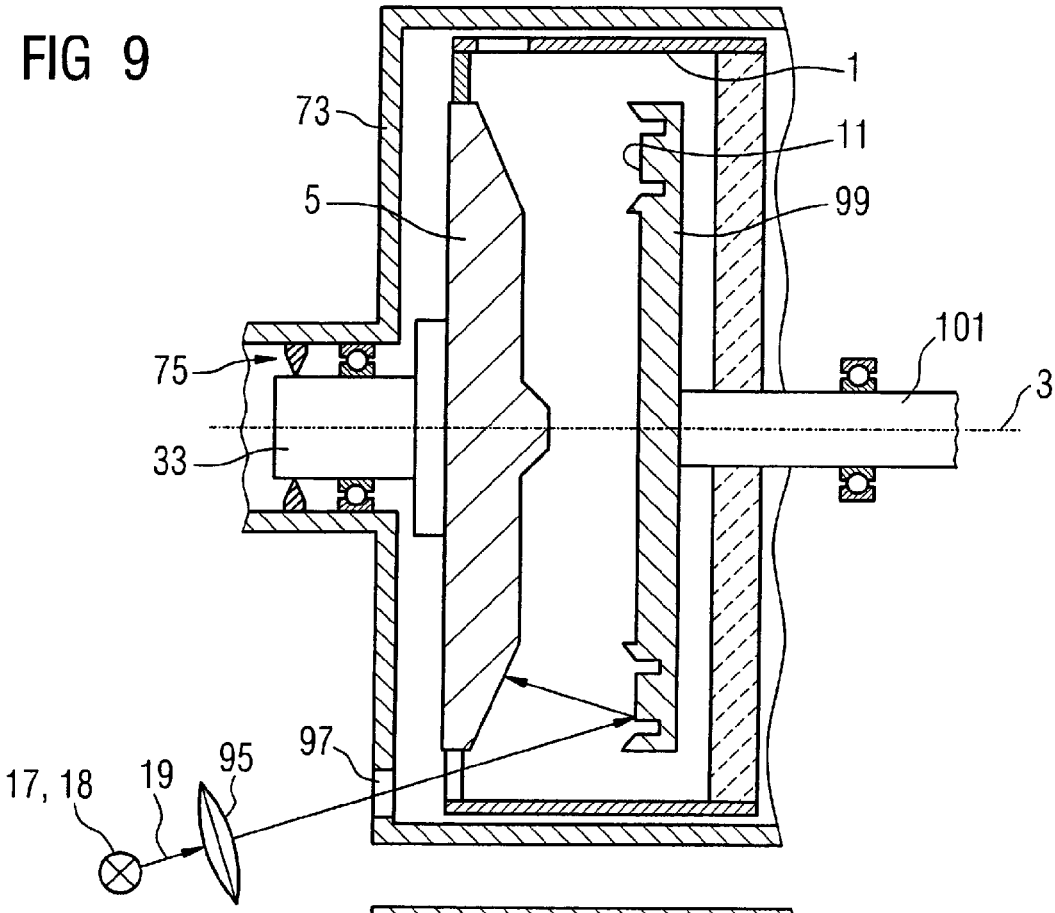

FIG. 9 shows a longitudinal section of a further embodiment of the x-ray radiator, now with an anode-side and non-central injection of the laser beam 19. In this embodiment the laser beam 19 is focused from the side of the anode 5 past its periphery by focusing optics 95, through an optically transparent window 97 spaced from the cathode 11, and onto the cathode 11. Here as well the window 97 can lie far back from the anode 5 in order to have an optimal protection from vaporization. In this embodiment it is clear that the cathode disc 99 (for example, made of SIGRADUR) does not also simultaneously have to be part of the vacuum casing 1, but rather can (for example) likewise be mounted such that it can rotate around the rotation axis 3. In this exemplary embodiment a high voltage of, for example, +150 kV is present on the cathode-side axle 101 while the drive shaft linked to the anode 5 is connected to ground. The axle 101 is directed through a ceramic disc for insulation of cathode 11 and anode 5. In this embodiment the cathode 11 is provided with recesses (notches) as heat transfer inhibitors as well as with projections that serve as electron focuses. As in the other embodiments, given use of an IR laser the optically transparent window is an IR window, advantageously made from quartz glass.

Figure 10:
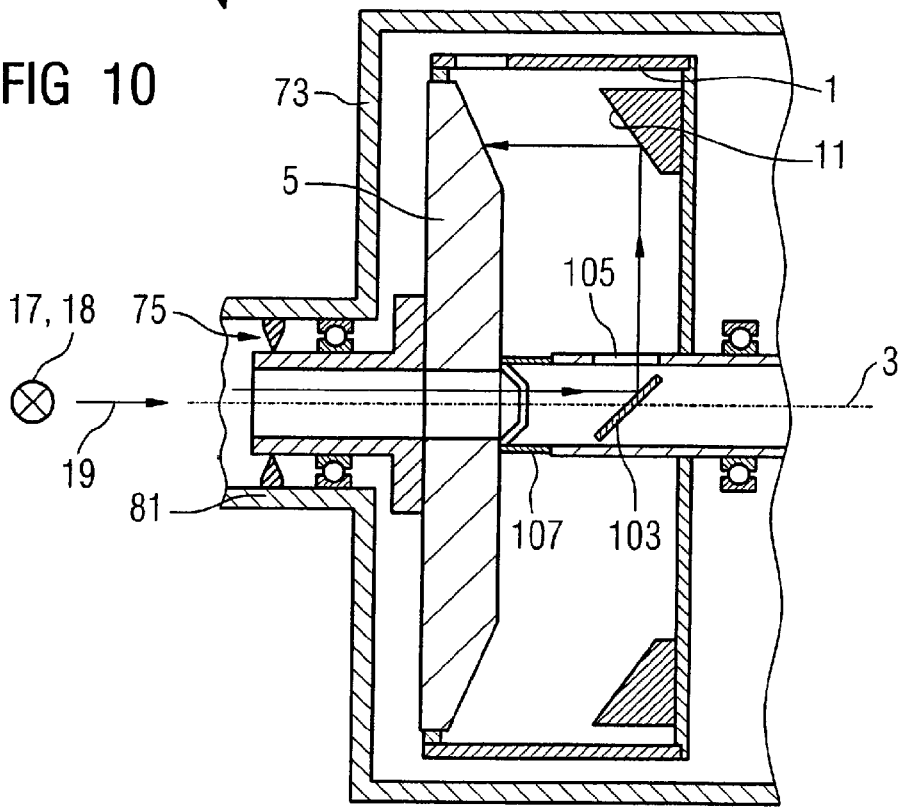

FIG. 10 shows a longitudinal section of a further embodiment of the x-ray radiator, with an anode-side and central injection of the laser beam 19. In this embodiment the region around the rotation axis 3 is executed hollow and continuous in the center. A deflection mirror 103 is located in the continuous hollow space, via which deflection mirror 103 the laser beam 19 is laterally deflected and is directed to the cathode 11 through a window 105 separating the hollow space from the vacuum. A ceramic 107 is located in one segment so that a high voltage can be applied between cathode 11 and anode 5. This embodiment increases the mechanical stability of the x-ray tube. The deflection mirror 103 can also be executed conically, for example similar to FIG. 6. The other embodiments the mirrors can also be executed similar to the mirror 103 shown in FIG. 10.

Figure 11:
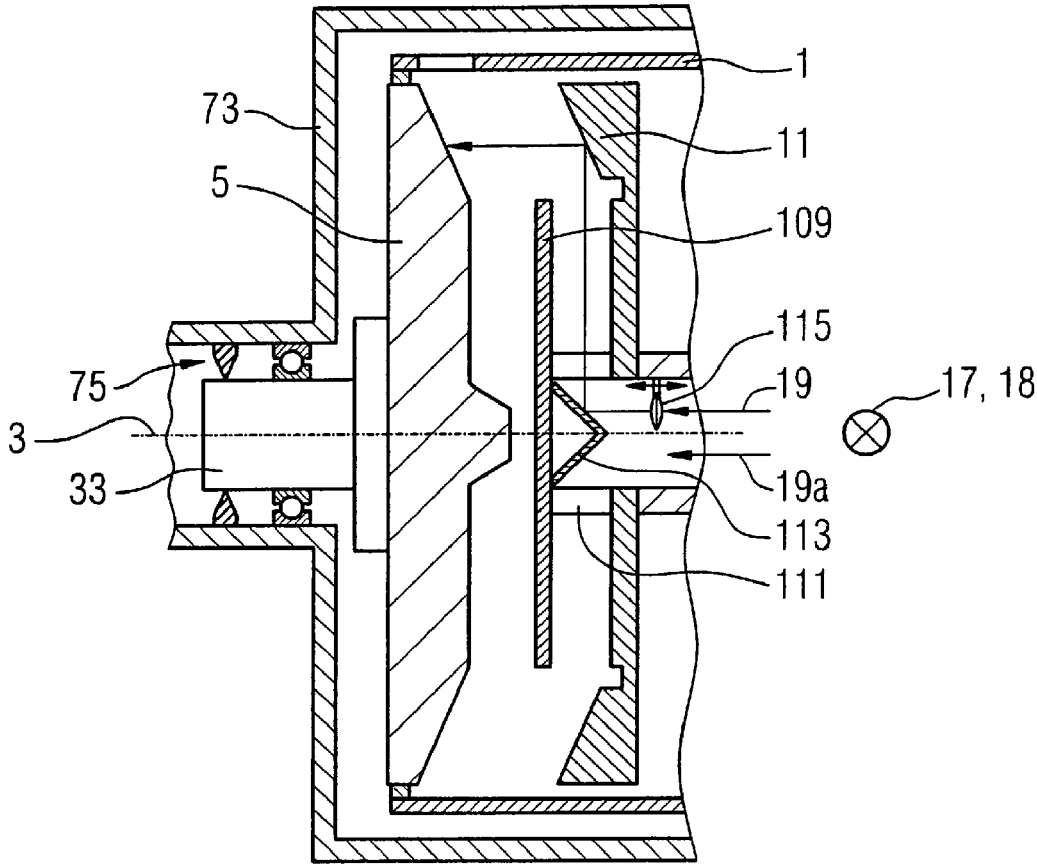

FIG. 11 shows a longitudinal section of a further embodiment of the x-ray radiator with a cathode-side and central injection of the laser beam 19. In this embodiment a mechanical vaporization disc 109 can represent an effective protection of the injection window 111 from a contamination. A laser beam 19 is directed from outside onto the vaporization disc 109 and is deflected through the window 111 to the cathode 11 by an asymmetrical mirror 113 seated on said vaporization disc 109. A second laser beam 19*a* for preheating of the focal path can also be additionally or alternatively used, as well as in the other exemplary embodiments. The second laser beam 19*a* can be offset by an angle of, for example, 5° in the direction of travel. In this example a lens 115 is provided in order to focus the first laser beam 19.

The preheating can generally occur in various ways, for example either by a mirror system that deflects an incident laser beam onto at least two separate focal points on the cathode, or by the use of laser beams that do not proceed parallel to one another, which laser beams strike the same mirror surface, but striking the focal path at different points due to their different irradiation angles, or strike the mirror system at different points via beams parallel to one another. In the case shown here, the two separate laser beams 19, 19*a* or a single, wider laser beam (not shown) will strike different points of the mirror 113 such that the shown rays will strike the cathode 11 offset by 180°.

The beam transport with optical conductors is not only reduced in the variants described above, but also it can be used in a "non-mechanical CT". In this particular embodiment the laser can be designed separate from the CT and a number of optical conductors (this number corresponding to the number of the projections in the examination) transports the laser beam in a variable manner to the stationary cathode in the gantry.

The embodiments of the window and deflection elements (mirror, totally reflecting surfaces etc.) place no limits on inventively deflecting the laser beam. The window and deflection elements can thus pass or deflect the laser beam in a variable manner, or only in a specific angle range around the rotation axis. The shape, direction and number of the partial rays of the laser can also be adapted to the x-ray radiator.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

a vacuum housing;

a photocathode that thermionically emits electrons into said vacuum housing upon irradiation of said photo cathode by a laser beam;

an anode;

electrical connections respectively to said cathode and said anode allowing application of a high voltage between said anode and said cathode that accelerates electrons emitted by said cathode toward said anode as an electron beam;

said anode having a surface in said vacuum housing disposed in a path of said electron beam that emits x-rays upon being struck by said electron beam;

said vacuum housing comprising an insulator that separates said cathode from said anode;

an arrangement for cooling at least said anode during emission of x-rays therefrom; and a stationary source of said laser beam that is disposed outside of said vacuum housing, and a deflection arrangement, entirely contained in said vacuum housing, that interacts with said laser beam in a path of said laser beam between said stationary source and a laser focal spot of said laser beam on said cathode, said deflection arrangement deflecting said laser beam in said path and causing said path to be non-linear between said stationary source and said laser focal spot.

2. An x-ray radiator as claimed in claim 1 wherein said deflection arrangements breaks said deflection path into respective linear path components that are non-linear relative to each other.

3. An x-ray radiator as claimed in claim 1 wherein said deflection arrangement comprises a reflection element disposed in said beam path.

4. An x-ray radiator as claimed in claim 1 wherein said deflection arrangement comprises an optical conductor in which said laser beam propagates.

5. An x-ray radiator as claimed in claim 1 wherein said vacuum housing comprises a mount allowing rotation of said vacuum housing around a rotation axis, and wherein said x-ray radiator comprises a drive that rotates said vacuum housing around said rotation axis.

6. An x-ray radiator as claimed in claim 5 wherein said vacuum housing comprises an optically transparent window allowing passage of said laser beam in said beam path into said vacuum housing, said optically transparent window being located in a region substantially adjacent to said rotation axis.

7. An x-ray radiator as claimed in claim 6 wherein said vacuum housing has an anode side at which said anode is situated and a cathode side, opposite said anode side, at which said cathode is situated, and wherein said stationary source is oriented relative to said vacuum housing to inject said laser beam along said beam path at said anode side in said region.

8. An x-ray radiator as claimed in claim 7 wherein said deflection arrangement comprises a reflection element mounted in said vacuum housing at said cathode side, opposite said optically transparent window.

9. An x-ray radiator as claimed in claim 6 wherein said vacuum housing has an anode side at which said anode is situated and a cathode side, opposite said anode side, at which said cathode is situated, and wherein said stationary source is oriented relative to said vacuum housing to inject said laser beam into said vacuum housing along said path at said cathode side in said region.

10. An x-ray radiator as claimed in claim 9 wherein said deflection arrangement comprises a reflection element mounted in said vacuum housing at said anode side opposite said optically transparent window.

11. An x-ray radiator as claimed in claim 6 wherein said drive comprises a drive shaft in rotational connection with said vacuum housing, said drive shaft having a hollow interior in which at least a portion of said beam path is contained, so that said laser beam is injected into said vacuum housing between said anode and said cathode.

12. An x-ray radiator as claimed in claim 1 wherein said anode has a periphery, and wherein said vacuum housing comprises an optically transparent window at said periphery and wherein said stationary source is oriented relative to said vacuum housing to inject said laser beam along said beam path through said optically transparent window.

13. An x-ray radiator as claimed in claim 1 comprising focusing optics that focus said laser beam onto said laser focal spot on said cathode.

14. An x-ray radiator as claimed in claim 13 wherein said focusing optics are integrated into said deflection arrangement.

15. An x-ray radiator as claimed in claim 1 wherein said vacuum housing is mounted for rotation around a rotation axis, and wherein said x-ray radiator comprises a drive that rotates said vacuum housing around said rotation axis, and wherein said deflection arrangement deflects said laser beam from an initial portion of said beam path proceeding substantially parallel to said rotation axis to a further portion of said beam path proceeding away from said rotation axis and toward said cathode.

16. An x-ray radiator as claimed in claim 1 wherein said vacuum housing is mounted for rotation around a rotation axis, and wherein said x-ray radiator comprises a drive that rotates said vacuum housing around said rotation axis, and wherein said stationary source is oriented relative to said vacuum housing so that at least a portion of said beam path coincides with said rotation axis.

17. An x-ray radiator as claimed in claim 1 wherein said cathode comprises a support layer on which a photosensitive cathode surface is disposed from which said electrons are emitted, and wherein said deflection arrangement deflects said laser beam onto said surface.

18. An x-ray radiator as claimed in claim 1 wherein said cathode is an annular ring.

19. An x-ray radiator as claimed in claim 1 comprising a voltage source connected to said deflection arrangement that selectively applies a voltage to said deflection arrangement.

20. An x-ray radiator as claimed in claim 1 wherein said laser beam is a first laser beam, and comprising a source for a second laser beam that pre-heats said cathode before said cathode is irradiated by said first laser beam.

* * * * *